United States Patent [19]

Jameel et al.

[11] 4,222,020

[45] Sep. 9, 1980

[54] CONTROL WINDING FOR A MAGNETIC LATCHING REED RELAY

[75] Inventors: Khaja M. Jameel, Glen Ellyn; James V. Koppensteiner, Chicago, both of Ill.

[73] Assignee: GTE Automatic Electric Laboratories Incorporated, Northlake, Ill.

[21] Appl. No.: 26,140

[22] Filed: Apr. 2, 1979

[51] Int. Cl.[3] ..... H01H 51/27

[52] U.S. Cl. ..... 335/153; 335/151

[58] Field of Search ..... 335/153, 151, 154; 361/208, 194, 168

[56] References Cited

U.S. PATENT DOCUMENTS

| | | | |
|---|---|---|---|
| 3,793,601 | 2/1974 | Anger et al. | 335/153 |
| 3,805,378 | 4/1974 | Archer et al. | 335/153 |
| 4,083,025 | 4/1978 | Meuller et al. | 335/151 |

*Primary Examiner*—Harold Broome
*Attorney, Agent, or Firm*—Robert J. Black

[57] ABSTRACT

A magnetic latching reed relay including a single continuous control winding disposed about an encapsulated reed switch having a pair of reeds constructed of a remanent magnetic material. The reeds are normally biased in an open position. When a first pulse of current, of a certain amplitude, is applied to the control winding a magnetic flux field is generated which magnetically saturates the reed blades, producing magnetic poles of opposite polarity at the contacting ends of the reeds which overcomes the normal mechanical bias of the blades, closing the contacts. A second pulse of current of an opposite direction and of approximately half the amplitude of the first pulse is then applied to the control winding and a reverse magnetic flux field is generated which is insufficient to magnetically saturate the reed blades and the magnetic polarity established thereby being also insufficient to overcome the normal spring bias of the blades, thus allowing the blades to return to the normal or open position.

5 Claims, 9 Drawing Figures

CONTROL WINDING FOR A MAGNETIC LATCHING REED RELAY

BACKGROUND OF THE INVENTION

1. Field of the Invention

This invention relates generally to electromagnetic switching devices and more particularly to an improved magnetic latching reed delay.

2. Description of the Prior Art

For many years the mainstay of switching and logic circuits has been, the well-known electromechanical relay. The relay consists of a magnetic flux-producing coil of wire and at least one contact pair operable in response to the generation of the magnetic flux. In order to achieve the operational speeds necessary to make relays compatible with transistor circuitry, a special type of relay, called the reed relay, has been designed. Reed relays usually have a pair of make contacts or reed blades placed within a glass-enclosed capsule with a control winding placed around the capsule.

Numerous improvements have been made to such reed relays to improve their time-response characteristics and to provide for self-holding capability. For example, a current pulse through the control winding causes the relay to operate and remain operated until a second currect pulse is applied. One such type of self-holding relay has contacts made from a magnetic material which, when exposed to a magnetic flux, will assume a magnetic state and will remain in that state until exposed to a magnetic flux of an opposite direction. These relays are normally called remanent reed relays. An example of such a relay is taught by U.S. Pat. No. 3,059,075 issued to R. L. Peek on Oct. 16, 1962.

Various arrangements of control windings have been employed with magnetic latching reed relays. One such arrangement is taught by U.S. Pat. No. 3,037,085 issued to T. N. Lowry on May 29, 1962. This arrangement employs a principle of differential excitation and uses two pairs of windings connected so that the relay is released, i.e., the contact pair is opened, by applying a current pulse to one pair of windings. The relay is operated, i.e., the contact pair is closed, by concurrently applying pulses of the same polarity to both pairs of windings. A problem existing with the differential excitation arrangement, is that the current pulse which operates the relay (closes the contact pair) must, be a dual pulse applyied to both windings concurrently. This results from the fact that, the application of current to a single winding of the relay causes the relay to release. Thus, from a circuit design standpoint, provisions must be made for supplying two simultaneous pulses of current. In certain applications, such as in selectable matrix arrays, it may be desirable to operate a relay only upon coincidence of pulses, in logic circuitry such a result is difficult and costly to achieve.

Another control winding arrangement is taught by U.S. Pat. No. 3,793,601 issued to R. J. Anger et al on Feb. 19, 1974. This arrangement operates or releases the reeds with a single pulse. Each of a pair of identical release windings is arranged over a corresponding one of a pair of reeds. The release windings are series connected so that a single pulse applied to the windings causes a magnetic field of one direction to be produced around one reed and a magnetic field of an opposite direction to be produced on the other reed. The resultant magnetic flux is such that the contact ends of the reeds are of the same magnetic polarity and thus separate. An operate winding in association with one of the two release windings is wound in a manner as to produce a magnetic flux magnitude greater than the magnetic flux magnitude generated by the associated release winding and having a flux direction opposite to the flux direction produced by the associated release winding. The operate winding is series connected to the associated winding, so that, a single current pulse flowing through the operate and the pair of release windings causes the contact ends of the reeds to have magnetic states of opposite polarity, with the result that the contact ends of the reeds attract, closing the contact pair. Such arrangement is costly requiring at least three separate and distinct windings, adds unwanted weight and bulk to the relay, and increases the assembly time.

Accordingly, it is an object of the present invention to provide a single coil self-holding remanent reed relay capable of single-pulse selective operation.

SUMMARY OF THE INVENTION

The object of the present invention is achieved by arranging a pair of remanent reed contacts with a single continuous magnetic flux producing winding over the contact pair. The contact pair free ends are normally biased in an open position. To close the contact pair, a positive pulse of current, of sufficient amplitude to magnetically saturate the contact pair is applied. The resultant magnetic flux increases the attraction between the free ends of the contact pair which overcomes the normal mechanical or spring bias of the blades, closing the contacts.

To open the contact pair, a negative pulse of current of approximately half the amplitude of the positive pulse is applied to the winding. Normally if this pulse was of the same amplitude as the positive pulse the contact pair would again receive a large amount of magnetic flux, magnetically saturating the pair in an opposite direction and thereby remaining closed. In this case however, the negative pulse of half amplitude is insufficient to magnetically saturate the contact pair and as the pulse decays the contact pair retain insufficient remanent magnetic flux. As a result, the normal mechanical spring bias of the free ends is greater than their magnetic attraction and the contact pair opens.

BRIEF DESCRIPTION OF THE DRAWINGS

A better understanding of the invention may be had from the consideration of the follow detailed description taken in conjunction with the accompanying drawings in which.

DESCRIPTION OF THE PREFERRED EMBODIMENT

Figure 1:
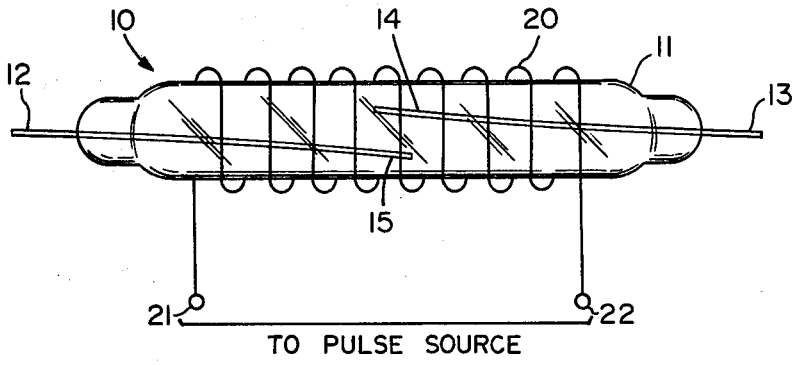
FIG. 1 is a view, partially schematic, of a magnetic latching reed relay in accordance with the principles of this invention.

The reed relay illustrated in FIG. 1 includes a reed switch shown generally as 10 which comprises a pair of reeds 12 and 13 sealed in a glass envelope 11. The free ends of the reeds 12 and 13 overlap and form contacts 15, 14 respectively. Each of the reeds 12 and 13 is constructed of a semi-hard remanent magnetic material exhibiting a plurality of stable magnetic states and which retains its last-set magnetic state. These magnetic states are established exclusively by a single control winding 20. Winding 20 is wound substantially over the reed blades 12 and 13 is what is assumed to be a clockwise direction from a first terminal 21 to a second terminal 22. Terminals 21 and 22 are disposed to be connected to an external pulse source providing the necessary excitation voltages to operate the reed switch. The semi-hard magnetic material used for reed blades 12 and 13 exhibits a square loop hysteresis characteristic and has a fast response to external magnetic fields. The magnetic polarity of the blades can be switched from one magnetic state to another in approximately 2-3 milliseconds.

Figure 2:
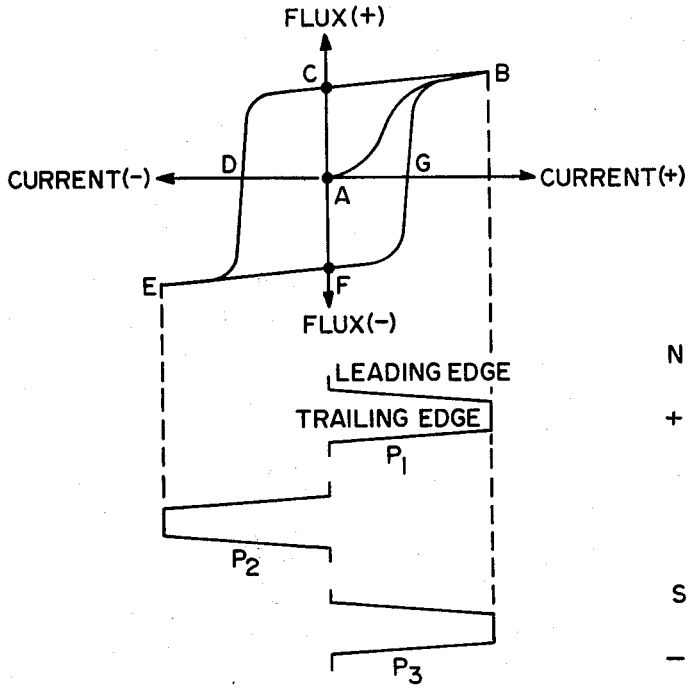
FIG. 2 is a graphic representation of the hystereis loop showing magnetic flux density for a first positive pulse of magnetizing force, a second negative pulse of magnetizing force, and a third positive pulse of magnetizing force all having equal amplitudes.
Figure 2A:
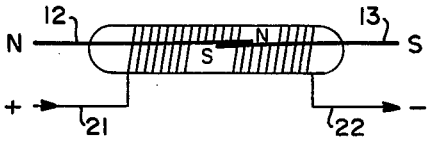
FIG. 2A is a schematic representation of the relay shown on FIG. 1, showing the direction of the magnetic flux field produced by the first positive pulse shown on FIG. 2.

Turning now to FIG. 2 and the accompanying reed capsule illustrations, 2A, 2B, and 2C the general principle of operation of a single coil control winding will be explained. It should be noted, that reed blades 12 and 13 are normally manufactured with a spring bias in an open position. The reed blades of a virgin reed relay are at a zero magnetic flux level as denoted by point A in FIG. 2. When a positive going current of pulse P1, of certain amplitude, is applied to the energizing coil 20 of the reed relay a magnetic field is established. This field saturates the reed blades to a level as denoted by point B. When the current pulse decays, the external magnetic field collapses, however, the blades retain a good portion of the magnetic flux because of the magnetic characteristics of the blade material. The remanent flux level in the blades is represented by point C. The magnetic polarity of the blades at this point is shown in FIG. 2A. The opposite magnetic poles at the contacts are mutually attracted and the contacts close.

Figure 2B:
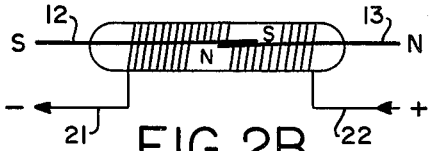
FIG. 2B is a schematic representation of the relay shown on FIG. 1, showing the direction of the magnetic flux field produced by the second negative pulse shown on FIG. 2.

When a negative going pulse P2 of a similar amplitude as P1 is applied to the energizing coil of the reed relay, a reverse magnetic field is established. This field saturates the reed blades in an opposite direction as represented by point E in FIG. 2. When the current pulse decays, the blades again retain a good proportion of the magnetic flux as denoted by point F. The magnetic polarity of the blades is shown in FIG. 2B. Again the magnetic characteristics of the magnetic material retains a good proportion of the magnetic flux and the blades remain closed.

Figure 2C:
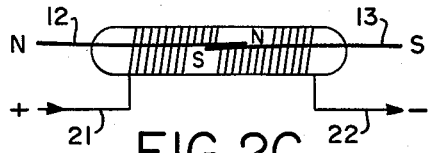
FIG. 2C is a schematic representation of the relay shown on FIG. 1, showing the direction of the magnetic flux field produced by the third positive pulse shown on FIG. 2.

By again applying a positive going pulse P3 to the energizing coil of the reed relay, the magnetic status of the blades is transformed from point F back to point C via points G and B respectively as shown again in FIG. 2. The magnetic polarity of the blades reverts back to the original as shown in FIG. 2C. Again the opposite magnetic pole at the contacting tips of the blades are attracted and the contact stays closed. It should be noted that in the transition from point F to point C, the blades go through point G the zero flux level where the contacts attempt to open but due to the magnetic characteristics of the blade material the magnetic flux retained cannot overcome the spring bias of the blades.

Taking advantage of the zero flux levels between remanent states C and F, the present invention is used to advantage by employing two different amplitude pulses. A first pulse of a certain amplitude is used to latch the contact and a second pulse of approximately half the amplitude of the first is used to unlatch the contact.

Figure 3:
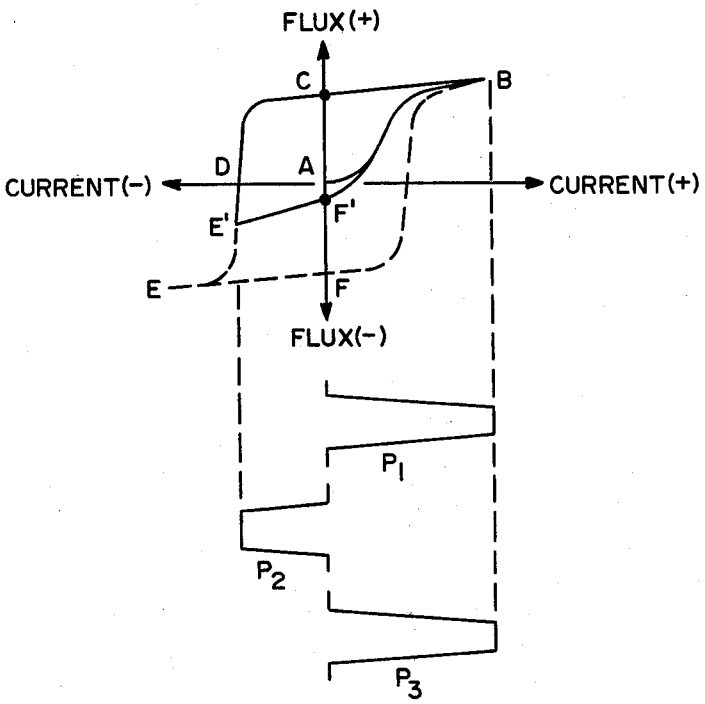
FIG. 3 is a graphic representation of the hystereis loop showing magnetic flux density for a first positive pulse of magnetizing force, a second negative pulse of magnetizing force having an amplitude of approximately half of the first positive pulse and a third positive pulse of magnetizing force having the same amplitude as the first positive pulse.
Figure 3A:
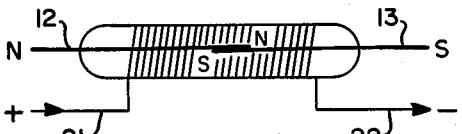
FIG. 3A is a schematic representation of the relay shown on FIG. 1, showing the direction of the magnetic flux field produced by the first positive pulse shown on FIG. 3.

Referring to FIG. 3, the magnetic status of the blades of a virgin reed relay is represented by point A the origin of the hysteresis loop. When a positive going pulse P1 of sufficient amplitude is applied to the switching element, the blades are magnetically saturated as noted by point B on the hysteresis loop. When the pulse decays, the blades acquire remanent state noted by point C. At point C the mutual attraction between the contacting tips of the blades is relatively greater than the spring bias of the blades and the contact is closed and stays closed as shown in FIG. 3A.

Figure 3B:
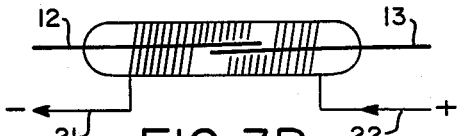
FIG. 3B is a schematic representation of the relay shown on FIG. 1, showing the direction of the magnetic flux field produced by the second negative pulse shown on FIG. 3.

In order to unlatch the contact, a negative goind pulse P2 of approximately half the amplitude of pulse P1 is applied to the energizing coil. This sets up a reverse magnetic field of approximately half the strength. This lower strength field is insufficient to saturate the blades and the magnetic status of the blades is transformed from point C to point E′ rather than E. When the pulse decays the blades acquire the remanent state represented by point F′. The magnitude of remanent flux at F′ is insufficient to keep the blades latched against their natural spring bias. Consequently the contacts spring open as shown in FIG. 3B.

Figure 3C:
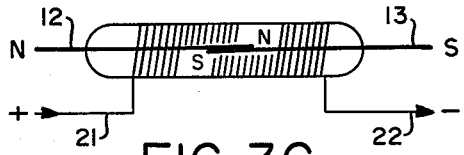
FIG. 3C is a schematic representation of the relay shown on FIG. 1, showing the direction of the magnetic flux field produced by the third positive pulse shown on FIG. 3.

In order to again close the contact a positive going pulse P3 of full amplitude is applied to the reed relay. The blades are again saturated and their magnetic status is transformed from point F′ to point B. Upon removing the pulse, the blades acquire the remanent state noted by point C. The contacts are again attracted and closed as shown in FIG. 3C.

The present invention has been described with reference to a specific embodiment thereof, for the purpose of illustrating the manner in which the invention may be used to advantage, it will be appreciated by those skilled in the art that the invention is not limited thereto. Accordingly, any and all modifications, variations, or equivalent arrangements which may occur to those skilled in the art should be considered to be within the scope of the invention.

What is claimed is:

1. A relay including a pair of remanently magnetic members with free ends, said free ends normally biased open and movable with respect to each other to close an electrical path when said pair of members are magnetized in a first direction and to open the electrical path when said members are magnetized in an opposite direction, comprising:

singular means for establishing a first and second magnetic direction with respect to said pair or members connected to a source of first pulses of a first polarity and amplitude and second pulses of a second polarity and of a amplitude substantially equal to half the amplitude of said first pulses;

said means energized in response to one of said first pulse to produce said first magnetic direction with respect to said pair of members, causing said free ends to attract and close said electrical path; and said means energized in response to one of said second pulses to produce said second magnetic direction with respect to said pair of members causing said free ends to release and open said electrical path.

2. A relay as recited in claim 1, wherein: said first pulse is a positive going pulse of sufficient strength to magnetically saturate said members, causing a mutual attraction in said free ends, said attraction being greater than said bias normally holding said free ends open, thereby closing said free ends.

3. A relay as recited in claim 2, wherein: said second pulse is a negative going pulse of less then sufficient strength to magnetically saturate said members in said second direction and insufficient to keep said free ends latched against said bias, allowing said free ends to return to said normal open position.

4. A relay as recited in claim 3, wherein: said second amplitude is a negative pulse of half the amplitude of said positive pulse.

5. A relay as recited in claim 1, wherein: said singular means is a single winding of electrically conductive material substantially wound about said pair of members.

* * * * *